US006244523B1

(12) United States Patent
Chung

(10) Patent No.: US 6,244,523 B1
(45) Date of Patent: Jun. 12, 2001

(54) PRESSURIZED INJECTOR

(76) Inventor: Chang-Chou Chung, 4Fl., No. 113 Da-duen 11th St., West Dis., Taichung (TW)

( * ) Notice: Subject to any disclaimer, the term of this patent is extended or adjusted under 35 U.S.C. 154(b) by 0 days.

(21) Appl. No.: 09/567,762

(22) Filed: May 9, 2000

(51) Int. Cl.[7] ..... B05B 9/47

(52) U.S. Cl. ..... 239/322; 222/389; 169/9; 169/33

(58) Field of Search ..... 239/320, 321, 239/322, 329, 330, 337; 222/389; 169/6, 9, 33, 71, 72, 73, 83, 85

(56) References Cited

U.S. PATENT DOCUMENTS 1,104,079 * 7/1914 Snyder .
1,302,678 * 5/1919 Lauterbach .
1,302,679 * 5/1919 Lauterbach et al. .
2,925,942 * 2/1960 Schmidt et al. ..... 222/389
3,405,845 * 10/1968 Cook et al. .
4,385,714 * 5/1983 Szabo et al. ..... 222/389
5,409,084 * 4/1995 Graf ..... 222/389
5,518,145 * 5/1996 Chen ..... 222/389

* cited by examiner

*Primary Examiner*—David A. Scherbel
*Assistant Examiner*—Christopher S. Kim
(74) *Attorney, Agent, or Firm*—Bacon & Thomas, PLLC

(57) ABSTRACT

A pressurized injector comprises a barrel, an injecting end fastened with one end of the barrel, a piston disposed in other end of the barrel and provided with a pull rod fastened therewith. The piston contains a liquid propellant, which reacts with a powdered propellant contained in a pressure chamber of the barrel to produce gas at such time when the pull rod of the piston is pulled. The gas pressure forces the piston to move toward the injecting end, thereby resulting in the ejection of a filling material contained in the barrel.

1 Claim, 5 Drawing Sheets

PRESSURIZED INJECTOR

FIELD OF THE INVENTION

The present invention relates generally to an injector, and more particularly to a pressurized injector which is used in a construction site to inject a filling material.

BACKGROUND OF THE INVENTION

As shown in FIG. 1, a pressurized injector of the prior art comprises a barrel 1A and a pressurized container 1B which is detachably fastened with a starting end "B" of the barrel 1A. The barrel 1A is provided with an injecting end "A" opposite to the starting end "B". The barrel 1A is provided therein with a piston 4A. The barrel 1A contains a construction filling material, which is forced out of the injecting and "A" by the piston 4A which is acted on by the pressure of gas contained in the pressurized container 1B.

Such a prior art injector as described above is defective in design in that it is vulnerable to gas leak in the event that the pressurized container 1B is not securely engaged with the starting end "B" of the barrel 1A in the wake of the adding of a filling material. If the filling material is added to the barrel 1A from the injecting end "A" of the barrel 1A, the piston 4A is vulnerable to being forced out of the starting end "B" of the barrel 1A by the excess pressure of the filling material.

SUMMARY OF THE INVENTION

The primary objective of the present invention is to provide a pressurized injector which is free from the drawbacks of the prior art injector described above.

The features and the advantages of the present invention will be readily understood upon a thoughtful deliberation of the following detailed description of a preferred embodiment of the present invention.

DETAILED DESCRIPTION OF THE PREFERRED EMBODIMENT

Figure 1:
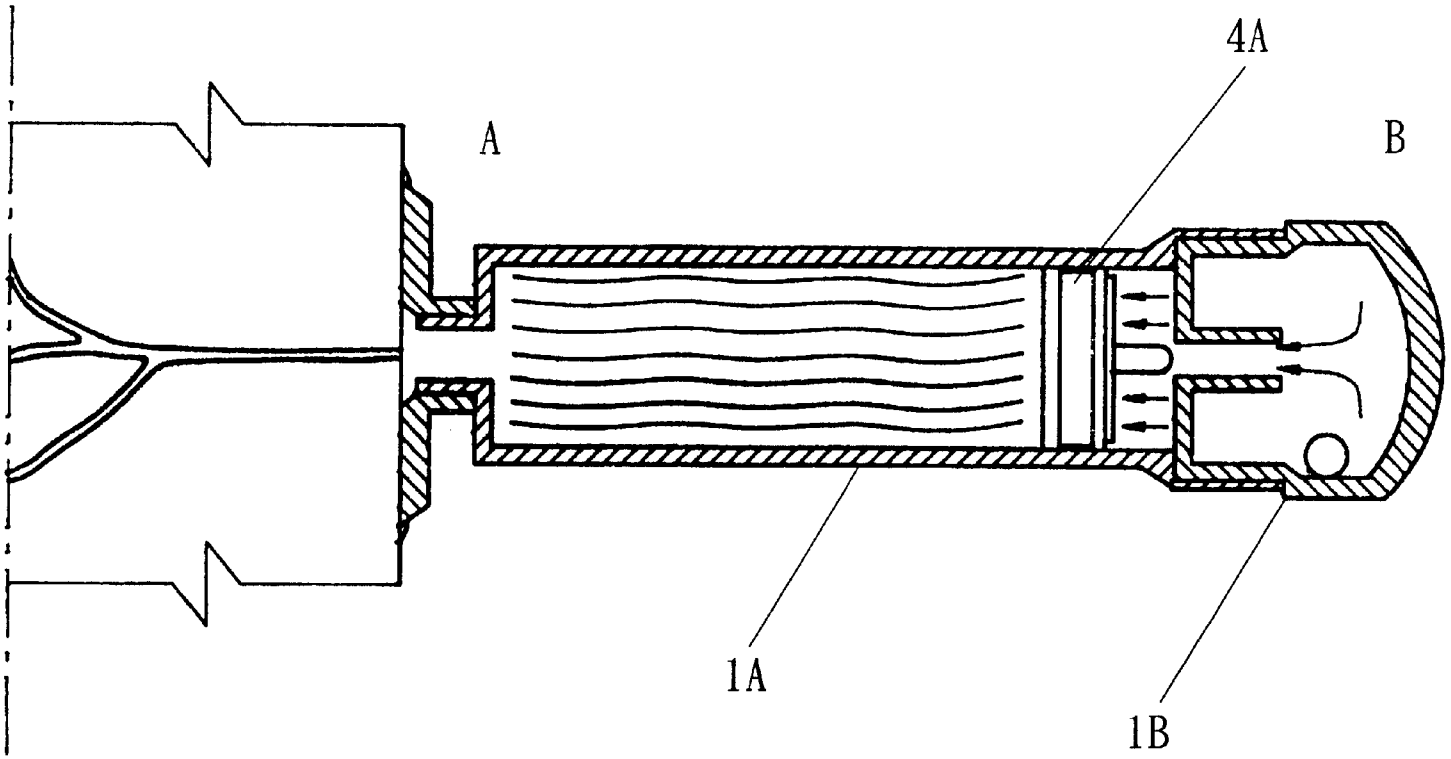
Fig. 1 Prior Art
FIG. 1 shows a sectional schematic view of an injector of the prior art.
Figure 2:
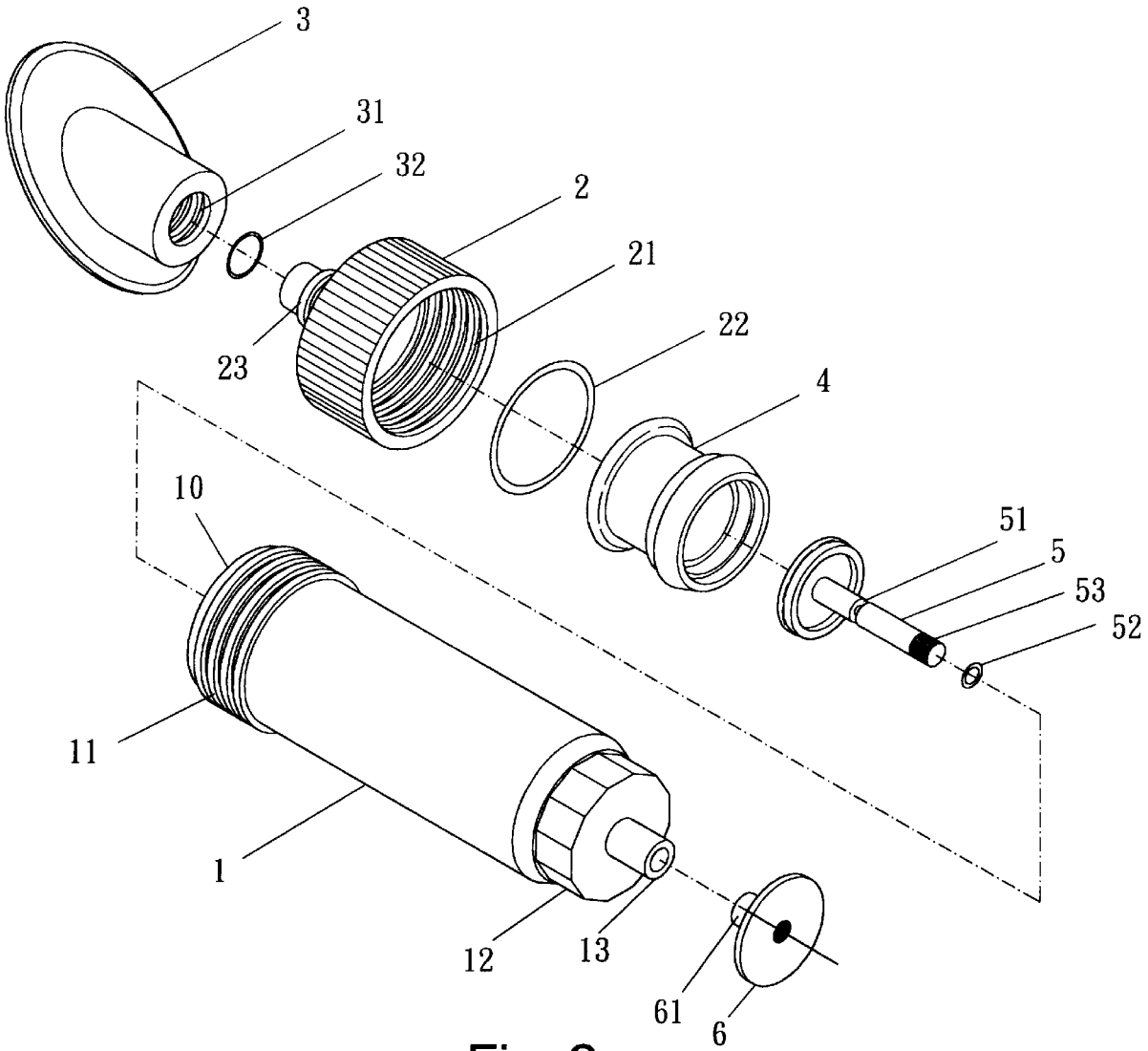
FIG. 2 shows an exploded view of the preferred embodiment of the present invention.
Figure 3:
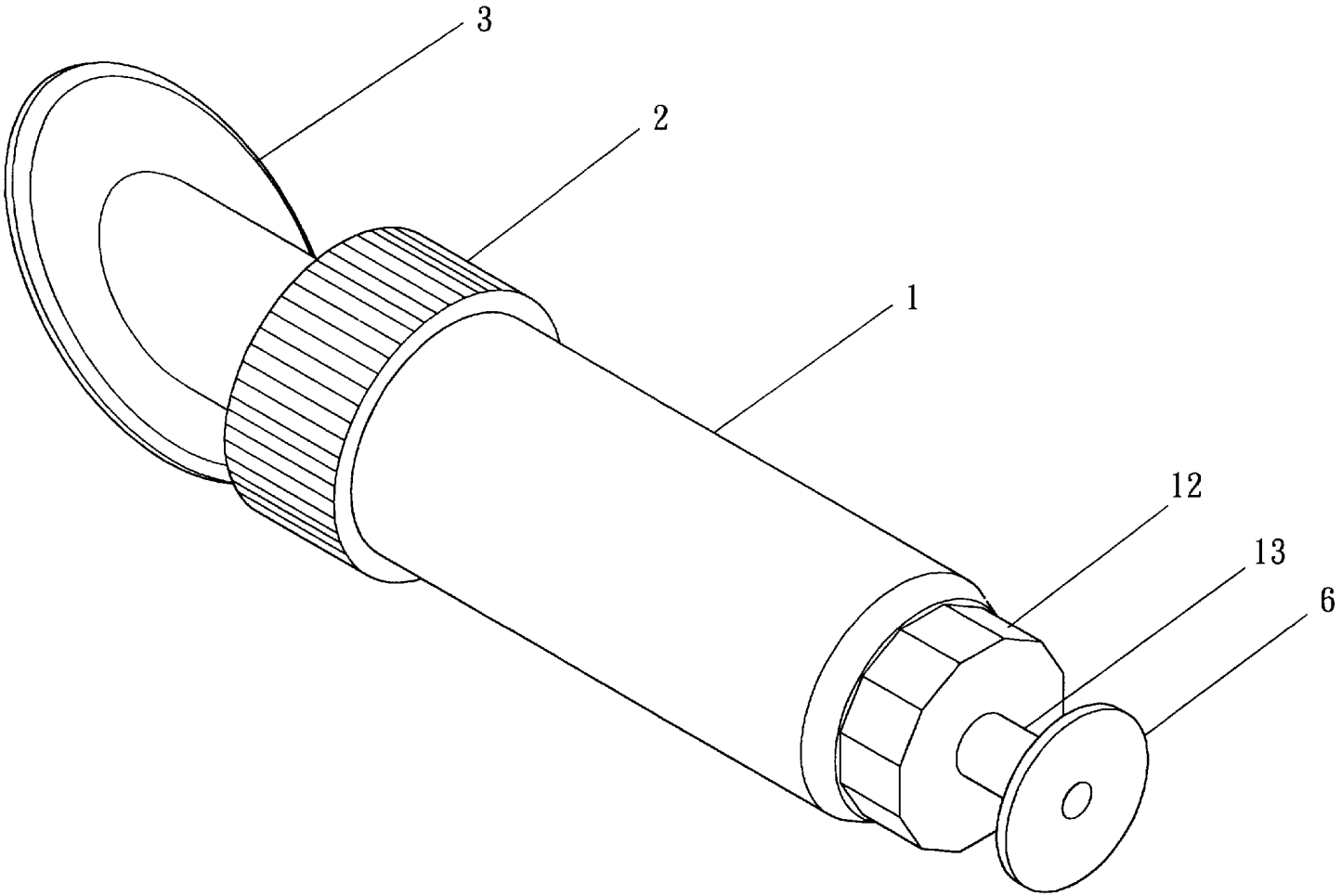
FIG. 3 shows a perspective view of the preferred embodiment of the present invention in combination.

As shown in FIG. 2 and 3, a pressurized injector of the preferred embodiment of the present invention comprises a barrel 1, a front cap 2, and injecting end 3, a piston 4, a partition pull rod 5, and a pull rod cover 6.

The barrel 1 is provided at the front end with an opening 10 and an outer threaded portion 11, and at the rear end with a pressure chamber 12 having a guide tube 13.

The front cap 2 is provided at the front end with an outer threaded portion 23, and at the rear end with an inner threaded portion 21.

The injecting end 3 is provided in the front end with an inclined plane having an inclination of 60 degrees. The injecting end 3 is provided in the rear end with an inner threaded portion 31.

The piston 4 is received in the hollow barrel 1 such that the rear end of the piston 4 is detachably engaged with the partition pull rod 5.

In combination, the piston 4 is disposed in the rear end of the barrel 1 such that the partition pull rod 5 is jutted out of the barrel 1 via the through hole of the guide tube 13, and that the exposed end of the pull rod 5 is engaged with the pull rod cover 6. The pull rod cover 6 has an inner threaded portion 61, which is engaged with an outer threaded portion 53 of the pull rod 5. A leakproof ring 52 is provided. The pull rod 5 is provided in the outer wall with an annular groove 51 for locating the leakproof ring 52. The outer threaded portion 11 of the barrel 1 is engaged with the inner threaded portion 21 of the front cap 2 in conjunction with a leakproof ring 22. The outer threaded portion 23 of the front cap 2 is engaged with the inner threaded portion 31 of the injecting end 3 in conjunction with a leakproof ring 32.

Figure 4:
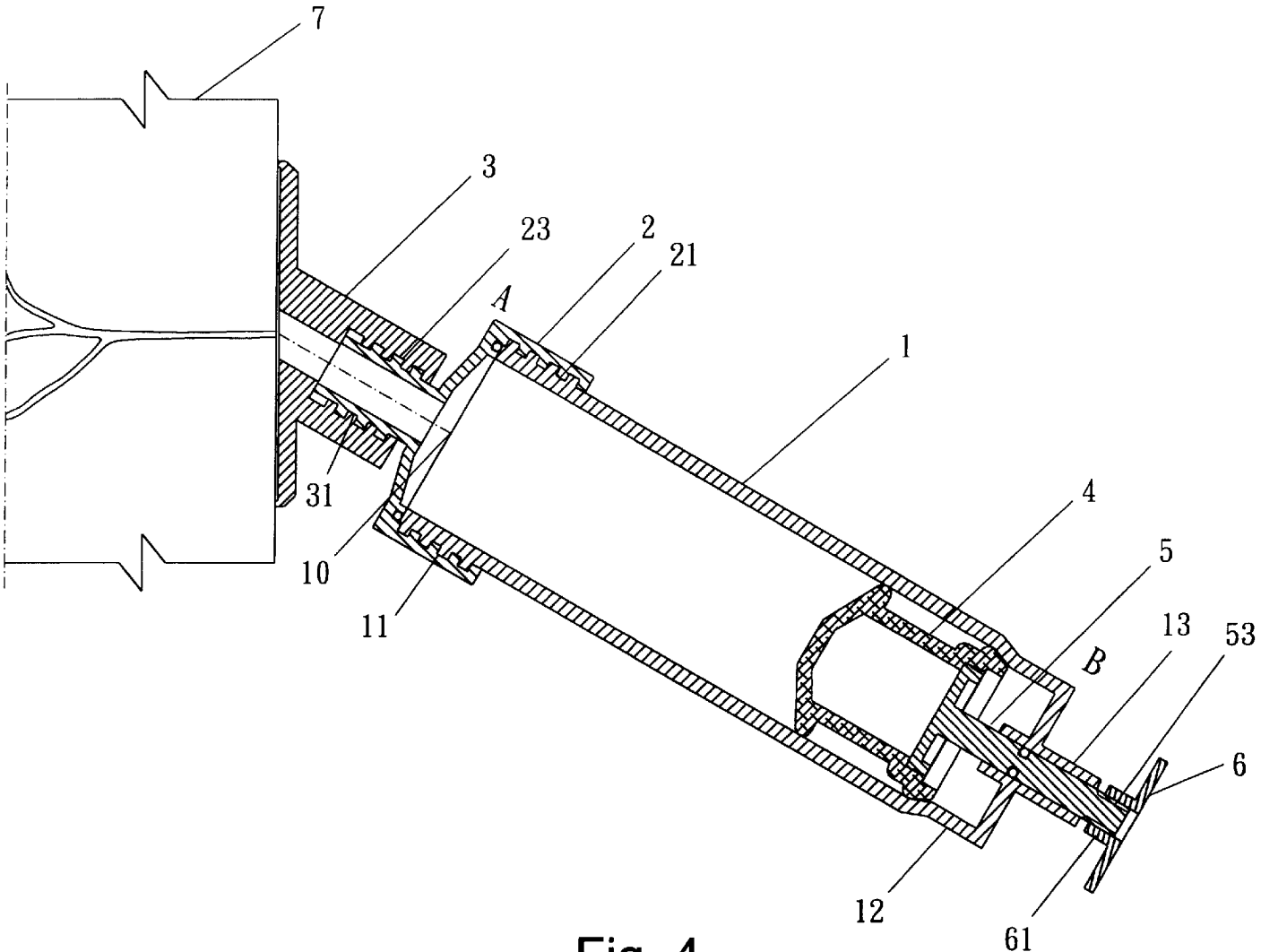
FIG. 4 shows a sectional schematic view of the preferred embodiment of the present invention in action.
Figure 5:
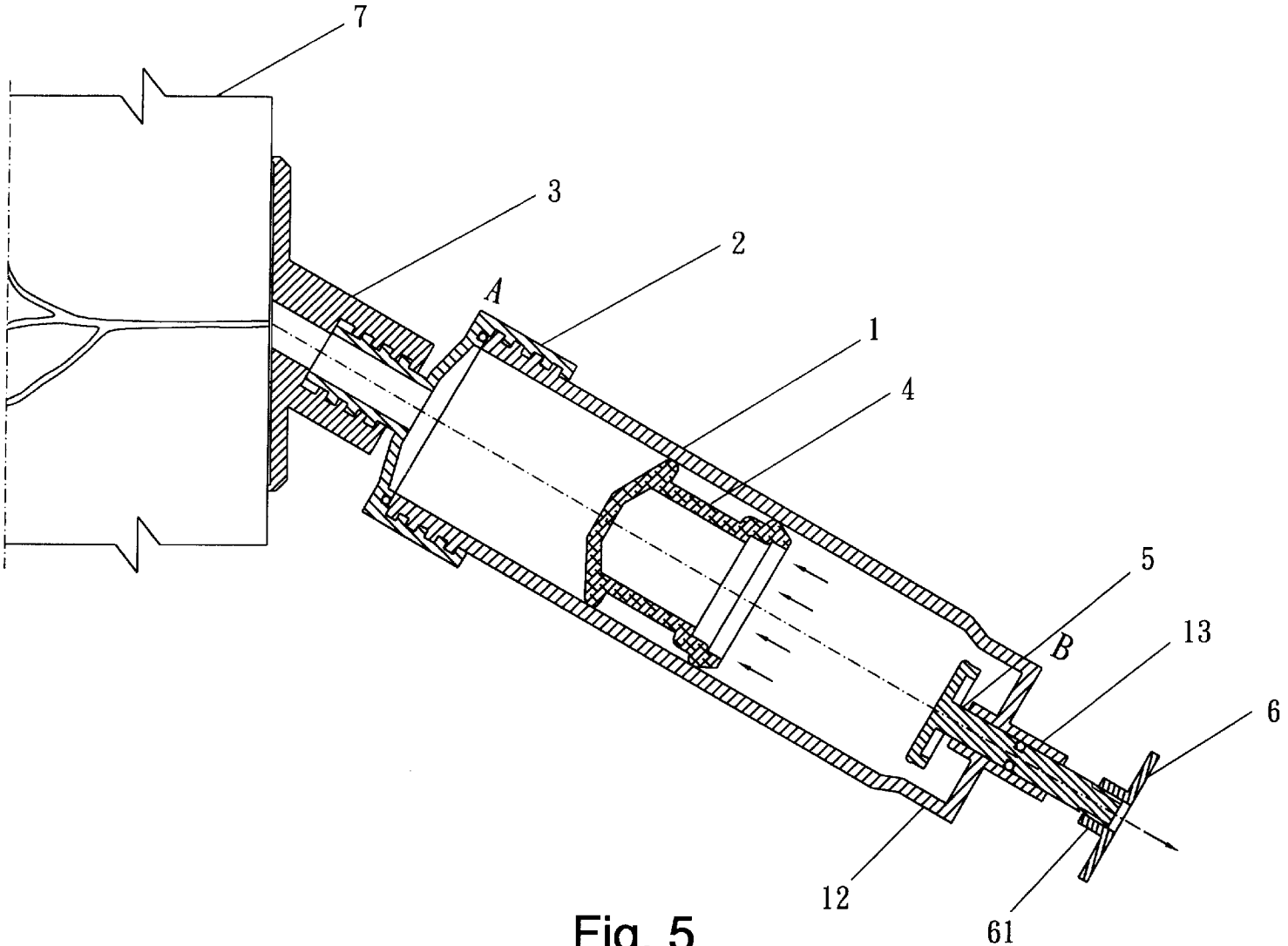
FIG. 5 shows another sectional schematic view of the preferred embodiment of the present invention in action.

As illustrated in FIGS. 4 and 5, a liquid propellant is contained in the piston 4, whereas a powdered propellant is kept in the pressure chamber 12 of the barrel 1. A construction filling material is deposited in the barrel 1 via the opening 10 of the injecting end "A" of the barrel 1. The inclined plane of the injecting end 3 is rested against a wall 7. As the pull rod cover 6 is pulled in the direction away from the starting end "B" of the barrel 1, the liquid propellant and the powdered propellant are mixed together to produce a gas pressure which pushes the piston 4 to move toward the injection end "A" of the barrel 1, thereby forcing the construction filling material out of the injecting end 3 into the wall (or ceiling) 7, as shown in FIG. 5.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

What is claimed is:

1. pressurized injector comprising:

a barrel provided at one end with an opening and an outer threaded portion, and at other end with a guide tube and a pressure chamber whereby said pressure chamber contains a powdered propellant;

a cap provided at one end with an outer threaded portion, and at other end with an inner threaded portion, said cap being engaged with said barrel such that said inner threaded portion of said cap is engaged with said outer threaded portion of said barrel;

an injecting end provided in one end with an inclined plane, and in other end with an inner threaded portion, said injecting end being fastened with said cap such that said inner threaded portion of said injecting end is engaged with said outer threaded portion of said cap; and a piston provided with a pull rod and disposed in said barrel such that a free end of said pull rod is jutted out of said guide tube of said barrel, and that said pull rod is provided at the free end with a pull rod cover fastened therewith whereby said piston contains a liquid propellant, which is mixed with the powdered propellant contained in said pressure chamber of said barrel at the time when said pull rod is pulled in the direction away from said guide tube of said barrel, thereby resulting in the production of gas which forces said piston to move in the direction toward said injecting end of said barrel so as to eject a filling material contained in said barrel via said injecting end.

* * * * *